US007207930B2

(12) United States Patent
Bonutti

(10) Patent No.: US 7,207,930 B2
(45) Date of Patent: Apr. 24, 2007

(54) EXERCISE DEVICE

(75) Inventor: Peter M. Bonutti, Effingham, IL (US)

(73) Assignee: Marctec, LLC, Effingham, IL (US)

( * ) Notice: Subject to any disclaimer, the term of this patent is extended or adjusted under 35 U.S.C. 154(b) by 0 days.

(21) Appl. No.: 11/101,942

(22) Filed: Apr. 8, 2005

(65) Prior Publication Data

US 2006/0229174 A1 Oct. 12, 2006

(51) Int. Cl.
*A63B 23/14* (2006.01)
*A63B 23/16* (2006.01)
*A63B 21/008* (2006.01)

(52) U.S. Cl. ..... 482/111; 482/44; 482/49

(58) Field of Classification Search ..... 482/111, 482/112–113
See application file for complete search history.

(56) References Cited

U.S. PATENT DOCUMENTS 3,081,634 A * 3/1963 Blaszkowski ..... 73/379.09
3,658,326 A * 4/1972 Fawick ..... 482/49
4,040,619 A * 8/1977 Landi ..... 482/49
4,146,222 A 3/1979 Hribar
4,171,802 A * 10/1979 Stoecker ..... 482/46
4,204,675 A 5/1980 McGinnis
4,288,071 A * 9/1981 Glickson ..... 472/134
4,685,665 A * 8/1987 Carlisle ..... 482/44
4,741,529 A 5/1988 Bloemendaal
4,988,093 A 1/1991 Forrest et al.
5,033,457 A 7/1991 Bonutti
5,076,570 A * 12/1991 Davis ..... 482/49
5,195,938 A 3/1993 Robertson
5,256,118 A 10/1993 Chen
5,267,923 A 12/1993 Piaget et al.
5,304,105 A 4/1994 Hsieh
5,346,444 A 9/1994 Hsieh
5,375,346 A 12/1994 Cole et al.
5,406,719 A 4/1995 Potter
5,465,428 A 11/1995 Earl
5,580,336 A * 12/1996 Coallier ..... 482/44
5,678,328 A 10/1997 Schmidt et al.
6,045,489 A 4/2000 Levine et al.
6,086,516 A 7/2000 Santos
6,299,585 B1 * 10/2001 Yoo ..... 601/118
6,419,611 B1 7/2002 Levine et al.
6,468,190 B1 10/2002 Fazio et al.
6,918,862 B1 * 7/2005 Comeau ..... 482/111

FOREIGN PATENT DOCUMENTS

DE 4214185 A1 * 11/1993

* cited by examiner

*Primary Examiner*—Stephen R. Crow
*Assistant Examiner*—Arun Chhabra
(74) *Attorney, Agent, or Firm*—Fleit Kain Gibbons Butman Bongini & Bianco; Paul D Bianco; Martin Fleit

(57) ABSTRACT

The present invention provides a system and method of exercise utilizing fluid containing bladders. The bladders may be in communication with each other so that compression of one bladder causes the fluid to be transferred to a neighboring bladder. The system may be used to exercise complementary muscle groups. Additionally, the system may be adjustable to provide different workout levels or so that the device can be used to exercise a variety of muscle groups.

17 Claims, 10 Drawing Sheets

EXERCISE DEVICE

FIELD OF THE INVENTION

The invention relates to an exercise system and method utilizing expandable bladders to provide resistive forces to the muscles being exercised.

BACKGROUND OF THE INVENTION

Exercise has long been known to be beneficial for people of all ages. In the past, many people were able to exercise simply by carrying out routine daily tasks that previously were labor intensive. The modern age, however, has succeeded in eliminating many "inconveniences" of life that involved physical exertion, and consequently there has been an increasing need for people to find other ways to exercise in order to achieve better health.

Today, a wide variety of exercise equipment is available for helping people achieve better health. Some devices and equipment help people achieve a cardiovascular workout, while other devices and equipment allow people to focus on muscle toning, strengthening, and development. Devices and equipment designed for muscle strength and development typically involve a muscle or muscle group applying a force in opposition to a resisting mechanical force generated by the exercise device. Thus, current devices and equipment can be highly specialized for the development of a particular muscle or muscle group.

While the ability to focus on a particular muscle or muscle group is beneficial, this specialization often neglects to allow for development of complementary muscle groups. Complimentary muscle groups include muscles that allow a person to move a part of their body and then return it to an original position. One example of complimentary muscle groups are biceps and triceps, which allow a person to bend their arm and then extend it again. Typically, exercise equipment that specializes in developing bicep muscles are not targeted for developing triceps without either modification of the equipment, repositioning of the exerciser, or both. Free weights useful for developing biceps, for example, may be too heavy for tricep development and would require an exerciser to choose which muscle group to develop during any set of exercises. As a result of this specialization, often people need to use multiple devices or complex exercise systems in order to strengthen or develop these complementary muscle groups.

Some exercise equipment requires a relatively uniform amount of exertion throughout the entire range of motion. Free weights, for example, provide the same weight resistance regardless of how far they have been lifted. Other exercise machines provide for variable resistance over the range of motion in which they are used. For example, some exercise machines simulating bench presses of weights may use camming mechanisms to vary the mechanical advantage given by the machine to the exerciser as the bar or grip is moved by the exerciser's arm extension. Thus, as an exerciser exerts a force to move the bar or grip, the machine can be designed to become progressively more difficult or more easy to move. Likewise, the use of a spring in an exercise device can result in requiring progressively increasing forces in order to further compress the device.

While such devices have been effective in some ways, they also suffer from disadvantages. Such machines tend to be large, being of high weight and requiring a large amount of space. These machines may also be difficult to use, requiring not only weight adjustment, but also adjusting the position of the user.

Another problem with such devices, or the use of conventional weights, is one of safety and convenience. If an exerciser lifts free weights connected to a bar, for example, relaxation of the muscles exercised during lifting may cause the weights to fall and injure the exerciser. Thus, it is difficult for a person exercising by such methods to safely stop in the middle of an exercise stroke, as the weights must be returned to a resting position.

SUMMARY OF THE INVENTION

The present invention provides a system and method of exercise utilizing expandable bladders. One or more of the bladders may define a reservoir that holds a fluid that can be at least partially transferred from one chamber or bladder to another. Alternatively, one or more of the expandable bladders may have compressible fluid or gasses inside that, when compressed, provide resistance to exercise the user's muscles.

One potential benefit of the devices of the present invention is that they may be small in size. In addition, some embodiments of the invention do not require heavy weights in order to achieve adequate resistance for muscle development. These features of the present invention may be implemented in a manner that also allows the devices to be easily transported or conveniently stored when not in use. Alternatively, the entire device, or just the patient contacting portion, can be made as a single-use disposable device. This minimizes, if not eliminates, the risk of disease transmission. Regardless of whether disposable or reusable, the size of devices according to the present invention allows use in a confined space, like an airplane, or other locations where the use of traditional exercise equipment would not be feasible.

Additionally, it is believed that several embodiments of the present invention also are safer to operate than some current exercise equipment. In this regard, the present invention can be used for low-impact work outs. Such work outs are particularly useful for disabled individuals, such as a stroke patient, partially bed ridden patients, or patients recovering (or as part of a post-operative therapy program) from surgery. Another application of the present invention is to build bone mass, for example, to delay the progression of osteoporosis.

One embodiment of the present invention involves a series of fluidly connected expandable bladders to provide resistive forces to the muscles being exercised. Two or more bladders may be connected, for instance by apertures or tubes that allow air or other fluid to be transferred therethrough. In this embodiment, the system includes a first bladder having a first stiffness and a second bladder having a second stiffness, wherein the second stiffness is greater than the first stiffness.

As a result, it is possible to achieve different levels of resistance from the exercise device in this embodiment depending upon which portion is being utilized or compressed. In particular, a first force is needed to compress the first bladder in order to force air or other fluid into the second bladder, while a second, different force is needed to compress the second bladder in order to force air or other fluid into the first bladder. The bladders may be configured or oriented so that compression of a first bladder helps a user develop a first muscle group, while compression of the second bladder helps develop a second muscle group. Preferably the second muscle group is complementary to the first group.

Upon removal of the compressive force, the expanded bladder compresses or returns toward its original shape by forcing some of the fluid back to the other bladder until reaching an equilibrium condition. The tube or aperture providing fluid communication between two or more expandable bladders also may be configured to partially restrict flow from one bladder to another. This may extend the time needed for the bladders to return to an equilibrium state. Restriction of flow between two or more bladders can be achieved, for instance, simply by providing a small aperture that allows for a more gradual transfer of fluid or gas from one bladder to another.

Alternatively, the aperture or tube may be formed from elastic material so that flow therethrough is substantially or fully restricted until the pressure gradient exceeds a desired level. In this configuration, a person using the device would need to impart a first force in order to displace some or all of the fluid or gas in a bladder, and then would need to impart a second, potentially smaller force in order to maintain equilibrium of the compressed device. As the force applied is reduced, pressure in the expanded bladder may cause the aperture to expand or open to allow the air or fluid to return to the previously compressed bladder.

In yet another alternative embodiment, the bladders need not be in fluid communication with each other. Instead, the bladders may be capable of surrounding a compressible gas, such as air, so that resistance by each bladder is achieved either by the compression of the gas, the resilient expansion of the bladder material, or both.

The bladder system can be incorporated into an exercise device or machine to work any muscle group, including, arm, leg, chest, back, shoulder, abdominal, or neck muscles. As mentioned above, and discussed more fully below, the system also may be useful in allowing complimentary muscle groups to be exercised.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention provides a system and method of exercise utilizing expandable bladders. The bladder system can be a stand-alone exercise device or alternatively may be incorporated into another device or machine to work muscles for arms, legs, chest, back, shoulder, abdomen, or the neck.

Figure 1:
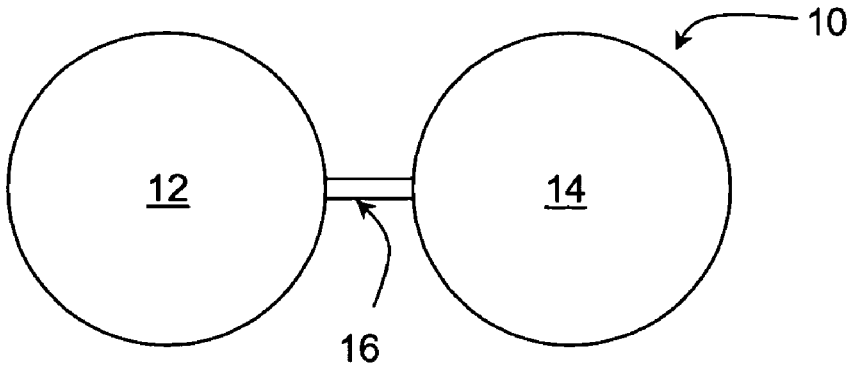
FIG. 1 depicts a bladder exercise system of the present invention.

Referring now to the drawing figures, FIG. 1 illustrates one embodiment of a bladder system 10 of the present invention that uses a plurality of fluidly connected bladders to provide resistive forces to the muscles being exercised. The bladder system 10 includes first and second bladders 12 and 14 in fluid communication with each other, such as through a tube 16. Alternatively, portions of the expandable bladders may be disposed adjacent to each other to define one or more apertures through which a fluid may travel. Unless indicated otherwise herein, the term "fluid" may include air or other gases in addition to liquids.

Returning once again to the embodiment of FIG. 1, a compressible or non-compressible fluid 18 is disposed within the bladders 12 and 14, such that a compression of one of the bladders 12 or 14 forces the fluid 18 through the tube 16 into the opposite bladder 12 or 14. It is also contemplated by the present invention that a malleable foam, gelatin, or other similar material can be placed in either or both of bladders 12 and 14. Such a material could occupy all or part of the volume of the bladder(s) and could be used either with or without the fluid.

The size, shape, construction, physical or material properties, and composition of the expandable bladders may be varied according to a desired use or performance of the exercise device. For example, while the bladders 12 and 14 shown in FIG. 1 are substantially similar in size and shape, one bladder may be configured to be substantially larger than the other. For instance, one bladder may have a volume of about 1.5 times or greater the volume of the other bladder under similar conditions of fluid pressure. Alternatively, the difference in volume of one bladder may be about 2 times or greater than the volume of another bladder, or may even differ by more than 4 times the volume of the other.

Providing a difference in bladder volumes is one way to achieve a different level of resistance that can be created when exerting pressure on the device during exercise. For instance, it is believed that the amount of exertion required to compress the smaller bladder, or to displace fluid from the smaller bladder into the larger one, will be less than the amount of exertion that may be required to compress the larger bladder a similar amount, or to displace a similar amount of fluid from the larger bladder into the smaller one.

Without being bound to any particular theory, it is believed that the reason for this difference in required exertion to displace similar amounts of fluid is that the relative increase in volumes required to accommodate the increase in fluid will be different. In other words, the smaller bladder will need to expand more than the larger bladder for a given amount of additional fluid, and therefore it will provide greater resistance to expansion. Thus, the resulting difference in resistance that can be achieved may be tailored to provide different workout levels from the same device. This feature may be beneficial when one muscle group is capable of exerting greater force than a complimentary muscle group.

Likewise, the shapes of the bladders may be designed to provide different amounts of resistance to a given increase of fluid or pressure. For example, while the shapes of the bladders shown in FIG. 1 are generally rounded or perhaps spherical, it is also possible that one or more of the bladders may be oblong in shape. As the pressure or fluid level increases, the mid-section of the oblong shape initially may expand more readily. The bladders may have other shapes as well, such as a pancake shape, an accordion shape, a belt or tubular shape, or the like.

The construction of the bladders also may be varied to provide different levels of resistance. For instance, the wall thickness of one bladder may be greater than the wall thickness of another bladder. In one embodiment, the wall thickness of one bladder is about 1.25 times or greater than the wall thickness of a second bladder. Greater differences in wall thickness may be used to provide even greater differences in resistance. For example, in one embodiment the wall thickness of one bladder may be about 2 times or greater, or even about 3 times or greater, than the wall thickness of a second bladder. U.S. Pat. No. 5,033,457, the contents of which are expressly incorporated by reference herein, also discloses other manners in which bladders can be provided to have different resistances or flexibilities.

Once the potential value of utilizing different bladder wall thicknesses for the present invention is understood from the discussion above, skilled artisans would appreciate that there can be several ways that these different wall thicknesses can be achieved. For instance, a bladder may be formed of multiple layers, or plies, of material. Thus, in an embodiment where one bladder wall thickness is about 2 times or greater than another bladder wall thickness, the first bladder may be formed by forming an additional layer of material over a first layer. The use of multi-ply constructions also allows the material and/or physical properties of one ply or layer to differ from the properties of another layer.

In another embodiment, the walls of the bladders may be constructed to include reinforcing fibers. The material used to form the reinforcing fibers may have a different modulus of elasticity (E) than that of the material used to form the bladders. The difference in modulus of elasticity may be used to provide even greater differences in resistance between the bladders. For example, in one embodiment the wall of one bladder include fibers having a modulus of elasticity of about 2 times or greater, or even about 3 times or greater, than the modulus of elasticity of a second bladder.

Figure 2:
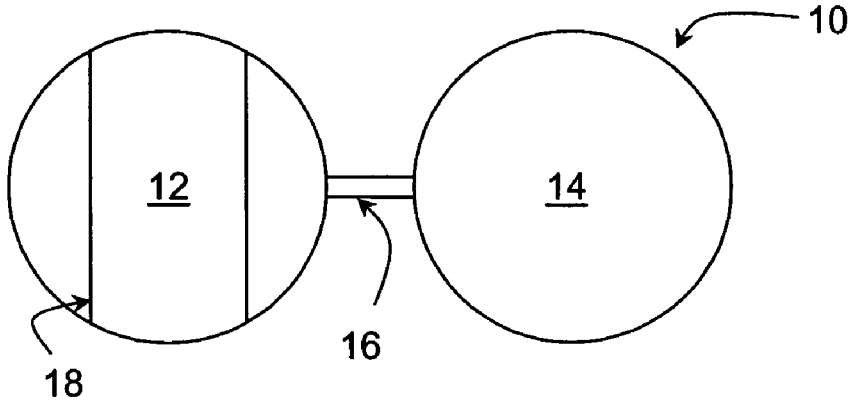
FIG. 2 depicts the bladder exercise system of FIG. 1 with an additional restrictive band disposed around a bladder.

In another alternative embodiment, a second layer of material formed around a bladder need not fully cover the first layer. As shown in FIG. 2, for example, a second layer may form a restrictive band 18 around only a portion or region of a bladder 12. The restrictive band 18 may be designed to be removable and interchangeable with one or more other restrictive bands having varying degrees of resistance. Additionally, the bands may be configured to fit over more than one expandable bladder. In this manner, a user of the device may further customize the degree of resistance of one or more expandable bladders by selecting from a plurality of bands.

The physical properties of the materials used to form an exercise device of the present invention also may be selected to provide a desired level of resistance. For example, the modulus of elasticity E of material used to form one bladder may be about 1.25 times greater or more than the modulus of elasticity of material used to form another bladder. Once again, the difference in modulus of elasticity may be even more pronounced, such as by 1.5 times or more, or by 2 times or more, depending on the degree of different resistance that is desired.

Likewise, the elasticity of one expandable bladder may be greater than the elasticity of another expandable bladder to provide different resistance. For example, the elasticity of material used to form a first bladder wall may be about 1.5 times or greater than the elasticity of a material used to form a second bladder wall. In other embodiments, this difference may be about 3 times greater, or even about 5 times greater.

It is believed that many different materials may be used to make devices of the present invention. By way of illustration, components of the present invention may be formed from urethanes, natural or synthetic rubbers, or the like. Preferably, the materials used to form the expandable bladders are elastomeric material that can stretch or expand and then substantially return to its original shape once pressure is released.

Additionally, the components of the present invention may be formed from a biodegradable material. It is contemplated that the present invention may be provided as a disposable exercise device. As a disposable device, the present invention could have a limited useful life, after which the device is easily disposed and reclaimed.

It should be understood that any selection of potential variations described above may be used either in combination with other variations or on its own. Thus, it is not necessary that any embodiment of this invention utilizes every variation to create a difference in resistance. In fact, many of the design elements described above may be "neutralized" from creating a noticeable difference in resistance between two expandable bladders. This can be achieved by making the design factor substantially the same for one bladder as another (e.g., bladder wall thickness, shape, and size may be relatively the same while other design elements are varied). In addition, in some instances it may be desirable for the design and performance of one bladder to be substantially the same as another expandable bladder.

Another way to express the differences in resistive forces that may result from design variations between expandable bladders is by stiffness or by effective spring constant of each bladder. For example, regardless of how the variations are achieved, it is preferred that one expandable bladder has an effective spring constant $k_1$ that is different from the effective spring constant $k_2$ of a second expandable bladder. Hooke's Law defines a spring constant k as the ratio of an applied static force to the linear displacement of a spring. Regardless of how the differences are characterized (e.g., resistance level, stiffness, effective spring constant, etc.), it is preferred that the differences are at least about 10 percent or greater, and more preferably the bladder designs result in a difference of about 25 percent or more. In some cases, a more pronounced difference may be desired, such as differing by about 50 percent or more, or even by about 100 percent or more (i.e., one bladder requires twice as much force to be exerted on it in order to achieve the same effect).

Figure 3:
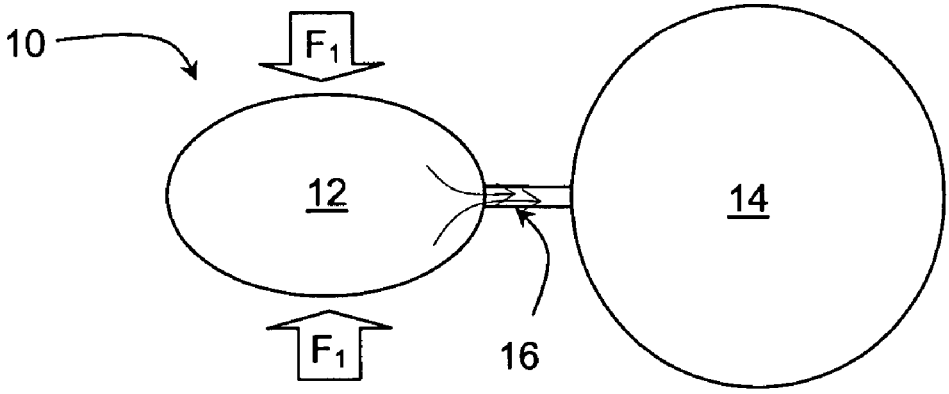
FIG. 3 depicts the bladder exercise system of FIG. 1 acted upon by a compressive force.

FIG. 3 illustrates the effect of exerting a compressive force $F_1$ on the first bladder 12 of one embodiment of the invention. The compressive force $F_1$ causes the fluid from the first bladder 12 to travel through tube 16 and into the second bladder 14. In response to the additional fluid, the second bladder 14 may expand to accommodate the additional volume. Alternatively, the fluid in the first and second bladders may be compressible gas, such as air or nitrogen. Thus, some embodiments of the invention may utilize a compressible fluid and one or more relatively non-expandable bladders so that exertion of a compressive force $F_1$ may reduce the internal volume of one or more bladders.

Returning to the embodiment shown in FIG. 3, upon removal of the compressive force $F_1$, the second bladder 14 contracts and eventually may return to approximate its initial shape and size. The higher pressure exerted by either the expanded wall of the second bladder, the compressed of gas inside the bladder, or both, results in the contraction of the second bladder 14 and expansion of the first bladder 12. In turn, this causes fluid from the second bladder 14 to travel into the first bladder 12 as the device returns to an equilibrium position.

The bladder system 10 of the present invention provides a resistance profile R to the compressive force F1. Initially, to force fluid from the first bladder 12 into the second bladder 14 the compressive force F1 exerted by a user must be equal to or greater than a threshold force TF. The threshold force TF is the force required to initiate expansion of the second bladder 14. This relationship is more likely to be observed where the fluid is liquid or relatively incompressible, but may be less likely observed if the fluid itself can be compressed. In cases where compressible fluid is present, the fluid may initially compress until reaching a level of pressure that meets or exceeds the threshold force of the second bladder. In general, the threshold force TF may be dependent on the elasticity or effective spring constant k of the second bladder 14. Thus, a low elasticity or high effective spring constant $k_2$ will likely result in a higher threshold force TF, while a high elasticity or low stiffness $k_2$ is likely to result in a lower threshold force TF needed before the second bladder expands.

Upon exceeding the threshold force TF, the second bladder 14 will begin to expand, still providing a resistance against the compressive force $F_1$. The resistance profile R can be a uniform resistance, where the stiffness $k_2$ and/or size of the second bladder 14 are selected to provide a relatively uniform resistance. Alternatively, the stiffness $k_2$ and/or size of the second bladder 14 may be selected to provide an increasing or decreasing resistance profile R.

Additionally, the tube 16 or aperture between two bladders may also be configured to resist the compressive force F1. For example, the diameter of the tube 18 can be selected to restrict the rate at which fluid can be transferred from one bladder to another. Whereas a relatively large diameter tube 16 may impart only negligible restriction on fluid flow, a small cross-sectional area and longer length connection between two bladders may significantly increases pressure losses during transfer of fluid from one location to another.

One feature that can be obtained by utilizing a connection that at least partially restricts fluid flow is that sudden relaxation of muscles by the exerciser need not result in the device suddenly and immediately returning to its original shape. Instead, there may be a more gradual return to equilibrium. For instance, in one embodiment, restricted fluid flow that results from full removal of compressive force may result in the delaying the return to initial shape of the device by about 0.25 seconds or more. In other embodiments, the restriction in fluid flow results in an even greater delay, such as about 0.5 seconds or more, about 1 second or more, or even about 5 seconds or more. These delays can be used to help ensure safe operation of the device. In addition the ability to control the rate at which fluid flows through the tube 16 or aperture also may be beneficial in customizing the resistance that a user will experience from the device during a workout.

The viscosity of the fluid 18 also may be used to control the resistance of the exercise device. The fluid viscosity is selected to provide a specific maximum flow rate through the tube 16. A more viscous fluid will have a decreased flow rate, providing a greater resistance. A less viscous fluid will have an increased flow rate, providing a decreased resistance. The benefits that may be obtained from selecting viscosity of the fluid to achieve a desired maximum flow rate are similar to the benefits described above for restricting fluid flow by choosing an appropriate cross-sectional area for the aperture or tube 16 connecting two bladders.

Figure 4:
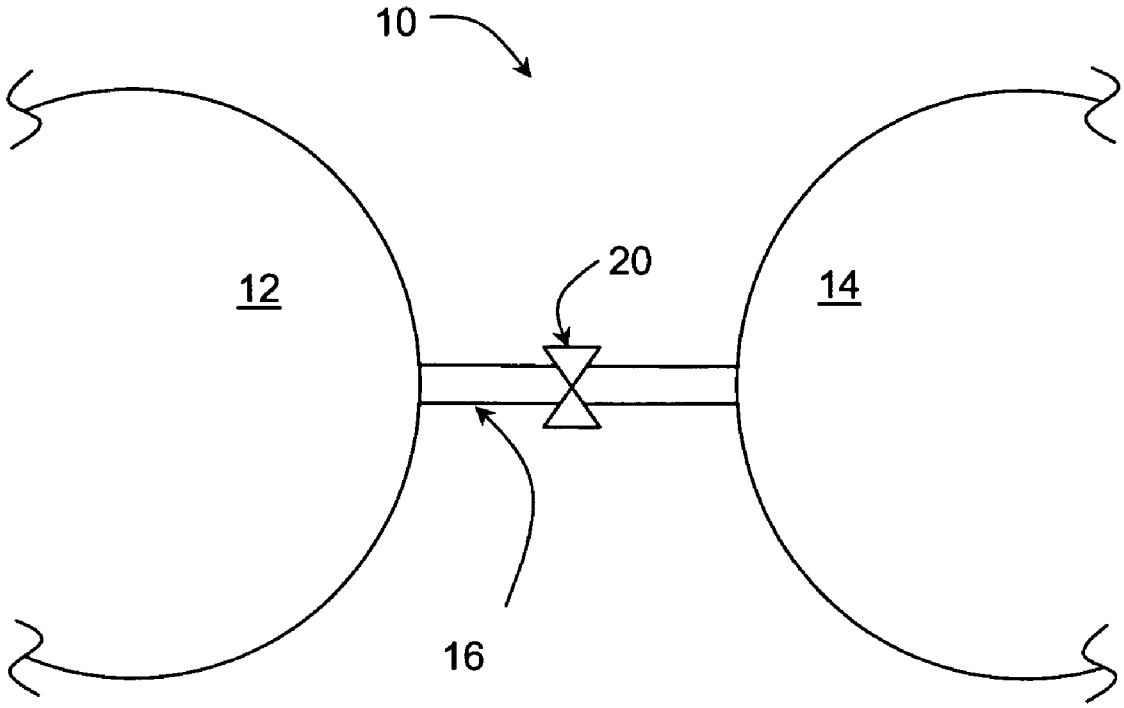
FIG. 4 depicts the bladder exercise system of FIG. 1 including a control valve.

Referring to FIG. 4, the fluid connection between two bladders may be configured so that the connection has a variable cross-section through which fluid may flow. That is, the size of opening between two bladders may be changed to control the rate at which fluid flows between them. As illustrated in FIG. 4, one way the cross-section may be varied is by operation of a valve 20 or similar device capable of selectively changing the size of the opening between the two devices. The valve 20 may be manually controlled or adjusted or alternatively may be operatively connected to an automated control system. In addition, the fluid connection 16 between bladders may be expandable. Thus, the connection may initially be small, or perhaps even substantially closed, but can expand in response to an increased pressure differential from one side of the connection to the other.

Thus, the bladder system 10 may include a control valve for regulating the diameter of tube 16 or flow of the fluid. In a fully open position, the tube 16 has a maximum diameter allowing for a maximum flow rate of the fluid 18. In a closed position, the control valve 20 minimizes the diameter of the tube 16, resulting in a minimum flow rate of the fluid through the tube 16. In one embodiment, the valve may be fully closed to substantially restrict or prevent any fluid flow. An exemplary control valve 20 includes a housing positioned about the tube 16. A threaded member may then be screwed into a threaded orifice in the housing. Rotation of the threaded member gradually causes the cross section of the tube 16 to be restricted or decreased. A knob may be provided on the threaded member to allow for easier manual adjustment.

Figure 5:
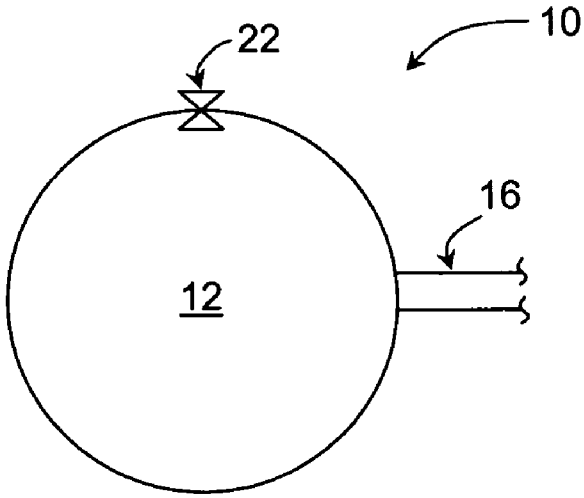
FIG. 5 depicts the bladder exercise system or FIG. 1 including a fill valve.

Referring to FIG. 5, one or more bladders may include a mechanism for controlling or adjusting the fluid pressure in the bladder system 10. In the illustrated embodiment, the control mechanism may be one or more fill valves 22. Skilled artisans would appreciate that a great variety of fill valves may be used, some non-limiting examples of which include screw caps, interference fit plugs (such as, for example, may be found on beach balls, or the like), or needle valves (such as found on sporting equipment), and the like.

A pressure gauge, transducer, or other similar means may be used in conjunction with the fill valve 22 to determine the fluid pressure in the bladder system 10. To increase the resistance to the compressive force $F_1$, fluid is added, through the fill valve 22, into the bladder system 10. The fluid may be pumped or injected into the bladder system 10 from a pressurized container, being added until the desired fluid pressure is present in the bladder system 10. To decrease the resistance to the compressive force F1, fluid may be evacuated from the bladder system 10.

The fill valve 22 may be opened, allowing some or substantially all of the pressurized fluid to exit the bladder system 10. Providing a fill valve not only allows fluid to be added or removed from the bladder system 10 in order to increase or decrease fluid pressure in a bladder, but also the valve may be useful in allowing for a substantial amount of the fluid to be removed in order to more conveniently store or transport the exercise device.

Figure 6:
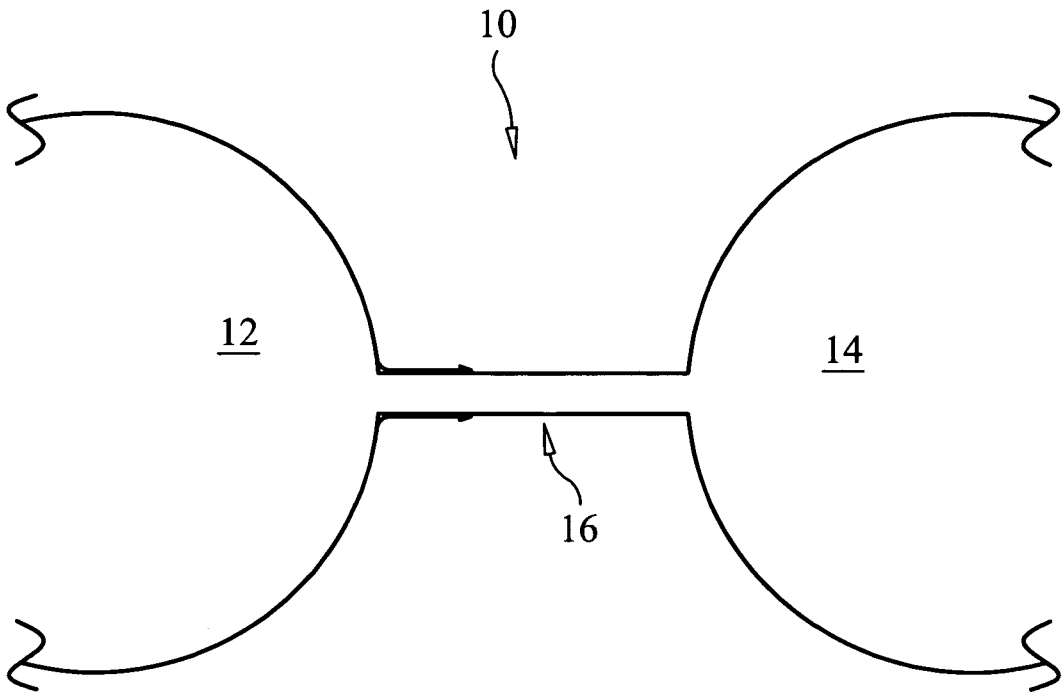
FIG. 6 illustrates an alternative embodiment where one or more bladders may be selective removed from the exercise system.

In an alternative embodiment, one or more of the bladders of the exercise device 10 may be removed from the fluid connection to another bladder. As shown in FIG. 6, one or more bladders may be selectively connected to or removed from the fluid connection 16. This configuration not only allows for adjustment of fluid levels and convenient storage and transport of the exercise device, but also allows different bladders having different properties to be used interchangeable on the device. In one embodiment, the exercise device comprises a plurality of interchangeable bladders where the resistance of at least one bladder differs from another bladder by about 10 percent or more, and more preferably differs in resistance by about 20 percent or more. An interchangeable bladder may be secured to a fluid connector 16 with clamps, by interference fit, or in any other suitable manner.

Preferably, the exercise device 10 has sufficient structural integrity to permit a wide range of initial fluid pressure (i.e., the internal pressure of the system without application of a compressive force $F_1$) without experiencing significant pressure loss over time. For purposes of this application, significant pressure loss is defined as the device losing more than 25 percent of its pressure over a 24-hour period of non-use. In some embodiments, it may be desirable for the device to be capable of withstanding an initial fluid pressure of at least about 50 psi without significant pressure loss, and more preferably can hold at least about 100 psi. It should be understood, however, that the device may be subjected to significantly greater pressures when subjected to compressive forces.

In the above examples, the exercise system 10 has been depicted as having a pair of bladders 12 and 14. However, it is contemplated the bladder system 10 can include multiple fluidly connected bladders. For example, the exercise system 10 may have 3 or more bladders, or even 5 or more bladders. Providing a combination of bladders may be beneficial, for instance, when the range of body motion involved in the exercise is long. For instance, stomach, arm, or leg exercises may involve body motion over a sufficiently large area to warrant use of more than just two bladders. In addition, providing more bladders may allow for greater variation of resistance over the range of motion.

Figure 7:
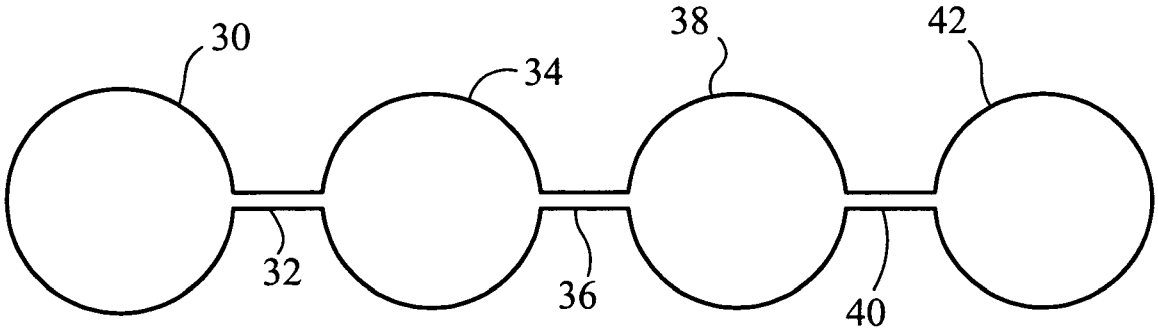
FIG. 7 depicts a bladder exercise system of the present invention including multiple serially linked bladders.

A non-limiting example of the use of 3 or more bladders in an exercise device 10 is illustrated in FIG. 7. As shown, the bladder system 10 may include multiple bladders serially connected. As generally shown in FIG. 7, a first bladder 30 may be fluidly connected, via first tube 32, to a second bladder 34. Second bladder 34 may then be fluidly connected, via second tube 36, to a third bladder 38. Optionally, the third bladder 38 also may be fluidly connected to a fourth bladder 38 via third tube 40. As a compressive force $F_1$ is applied to the first bladder 30, the fluid is compressed into the second, third, and fourth bladders 34, 38, and 42, providing a resistance to the compressive force $F_1$.

The stiffness of the second, third, and fourth bladders 34, 38, and 42 may be selected to provide a prescribed resistance profile R to the compressive force. For example, each the second, third, and fourth bladders 34, 38, and 42 can have the same stiffness k. Alternatively, each of the second, third, and fourth bladders 34, 38, and 42 can have different stiffnesses. The different stiffnesses are selected and arranged to provide the resistance profile R.

Likewise, flow rates between the bladders also may be varied to achieve a desired resistance profile R. The bladders 30, 34, 38, and 42 are serially connected with tubes 32, 36, and 40. As described above, the tubes 32, 36, and 40 provide a specific flow rate therethrough and can be used to adjust resistance the compressive force $F_1$. The tube diameters are selected to provide a prescribed resistance profile R to the compressive force $F_1$ and may be adjustable in the manner described above. A larger tube diameter will have an increased flow rate, providing a lesser resistance. A decreased tube diameter while provide a decreased flow rate, providing an increased resistance. Each of the tubes 32, 36, and 40 can have the same tube diameter, providing a uniform flow rated through each of the tubes. Alternatively each of the tubes 32, 36, and 40 can have different tube diameters, wherein the tube diameters are selected and arranged to provide the resistance profile R.

As discussed above, the sizes and arrangement of the bladders 30, 34, 38, and 42 can be selected to provide a prescribed resistance profile R to the compressive force $F_1$. Referring to FIG. 7B, the bladders 34, 38, and 42 are arranged in a decreasing size arrangement. Alternatively, as shown in FIG. 7C, the bladders 34, 38, and 42 are arranged in an increasing size arrangement.

The above-described elements may be used individually or in combination to design a bladder system 10 to provide a specific resistance profile R.

Figure 8:
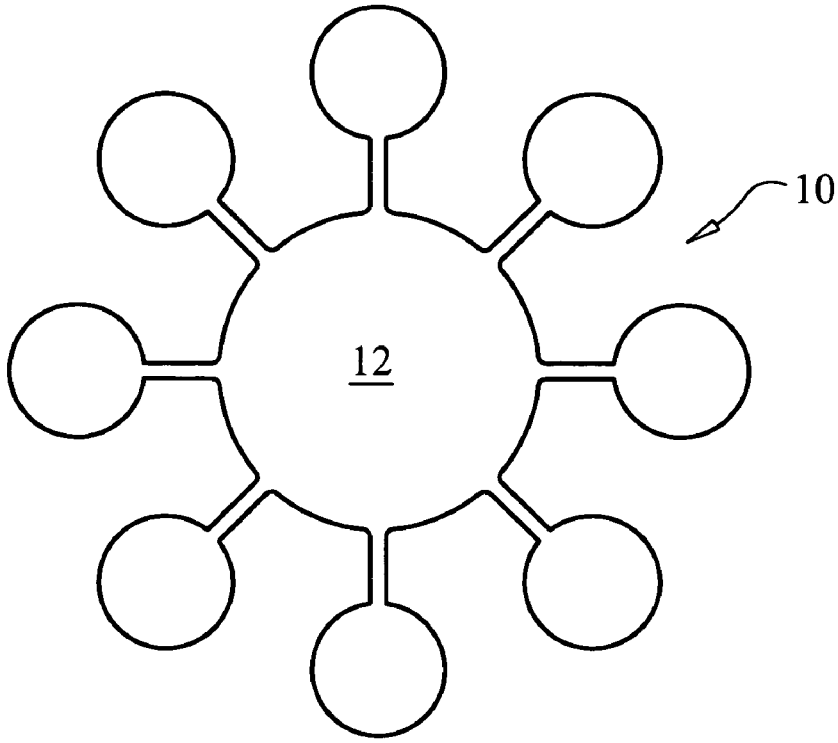
FIG. 8 depicts a bladder exercise system of the present invention including multiple linked bladders.

It is not necessary for every bladder of the exercise system 10 to be linked or connected serially with the others. Referring to FIG. 8, the exercise system 10 may include a central bladder 12 with multiple secondary bladders attached thereto. Each of the secondary bladders may be fluidly connected to the central bladder 50 with tubes or apertures in the manner already described above. In some embodiments, only a portion of the secondary bladders may be in fluid communication with the central bladder. Thus, some secondary bladders may be self contained in order to provide some cushioning or stabilization for the user. As a compressive force $F_1$ is applied to the central bladder 12, the fluid is compressed into fluidly connected secondary bladders providing a resistance to the compressive force F1.

As discussed above, each of the bladders in any embodiment may be sized or otherwise designed to have a desired stiffness in order to provide a specific resistance profile R in response to a compressive force $F_1$. Likewise any other design parameter discussed above also may be used with the embodiments illustrated in FIGS. 7 and 8.

Figure 9:
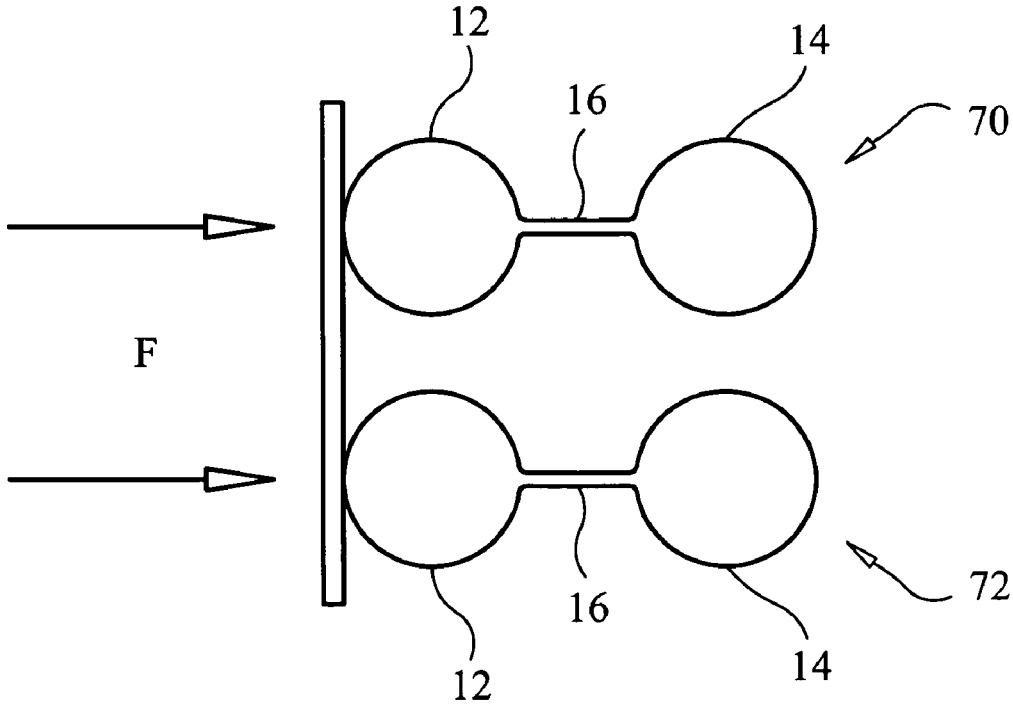
FIG. 9 depicts an exercise system including multiple bladder exercise systems.

In the above examples, the exercise systems 10 have been described as being a single collection of bladders. However, it is contemplated that multiple bladder systems 10 can be used in combination to provide a selected resistance profile R to the compressive force $F_1$. Referring to FIG. 9, a pair of bladder systems 70 and 72 are used in combination to provide a effective resistance profile R for the overall combination. Each of the bladders systems 70 and 72 can have the same or different individual $R_1$ and $R_2$ resistance profiles. The individual resistance profiles $R_1$ and $R_2$ are selected to provide the effective resistance profile R of the combined systems 70 and 72.

Figure 10:
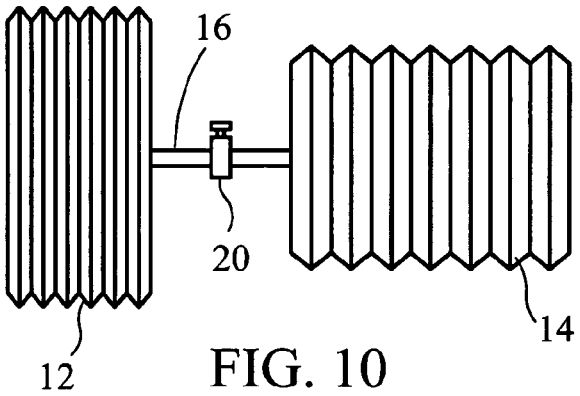
FIG. 10 depicting an bladder exercise system including accordion bladders.

Other bladder configurations also may be used with the present invention. For instance, one or more of the bladders may be formed from an inelastic (non-elastomeric) material so that it does not expand significantly when subjected to increased pressure during normal operation of the device. This type of bladder may be useful with compressible fluid or may also be used as an overflow reservoir. In addition, one or more bladders may have a pleated or accordion construction as illustrated in FIG. 10.

Figure 11:
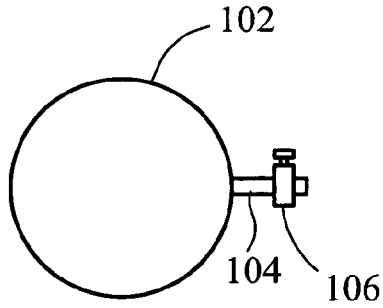
FIG. 11 depicts an alternative bladder exercise system of the present invention.

Referring to FIG. 11, the bladder system 100 also may include a vent port 104, such that when a compressive force is applied to the bladder 102 air is evacuated from the bladder 102 through the vent port 104. Upon removal of the compressive force, the bladder 102 reverts to its original form, drawing air in through the vent port 104.

Bladder 102 provides a resistance to the compressive force, wherein the resistance is dependent on the material properties of the bladder 102. The higher stiffness k of the bladder 102 results in the higher resistive force. The lower stiffness k of the bladder 102 results in the lower resistive force.

The vent port 104 may also be utilized to provide resistance to the compressive force F1. The diameter of the vent port 104 is selected to provide a specific flow rate of the fluid 108 from the bladder 102 through the vent port 104. A larger vent port 104 diameter will have an increased flow rate, providing a lesser resistance. A smaller tube diameter vent port 104 will have a decreased flow rate providing an increased resistance.

The bladder system 102 of the present invention provides a resistance profile R to the compressive force F1. Initially, to force the fluid from the bladder 102 through the vent port 104 the compressive force F1 must be equal to or greater than a threshold force TF. The threshold force TF is the force required to initiate expansion of the bladder 102. The threshold force TF is dependent on the stiffness k of the bladder 102, and the characteristic of the vent port 104. Upon removal of the compressive force, the bladder expands drawing air into the bladder 102 through the vent port 104.

The bladder system 102 may include a control valve 106 for regulating the diameter of vent port 104 and/or the flow rate of the fluid. In a fully open position, the vent port 104 has a maximum diameter allowing for a maximum flow rate of the fluid, providing a minimum resistance. In a closed position, the control valve 106 minimizes the diameter of the vent port 104, resulting in a minimum flow rate of the fluid through the vent port 104, providing a maximum resistance. Exemplary control valves are discussed above with respect to FIGS. 4 and 5.

Figure 12:
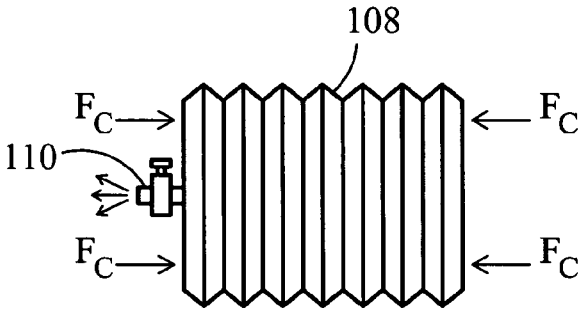
FIG. 12 depicts the accordion bladder system of FIG. 11 in a first position.
Figure 13:
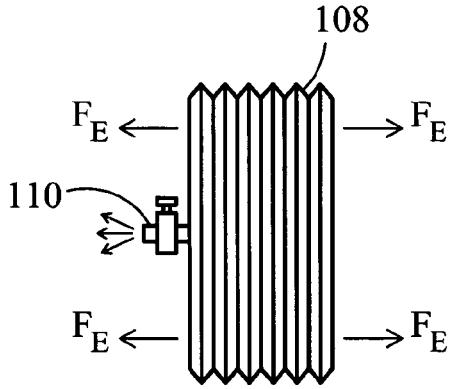
FIG. 13 depicts the accordion bladder system of FIG. 1 in a second position.

Referring to FIGS. 12 and 13, the bladder 108 is an accordion bladder, providing first and second resistances. When a compressive force $F_C$ is applied to the accordion bladder 108, air is evacuated from the bladder 108 through the vent port 110, providing the first resistance. When an expansive force $F_E$ is applied to the accordion bladder 108, air is drawn into the bladder 108 through the vent port 110, providing the second resistance. Both the first and second resistances are dependent upon the stiffness of the bladder 108 and the configuration on the vent port 110.

Figure 14:
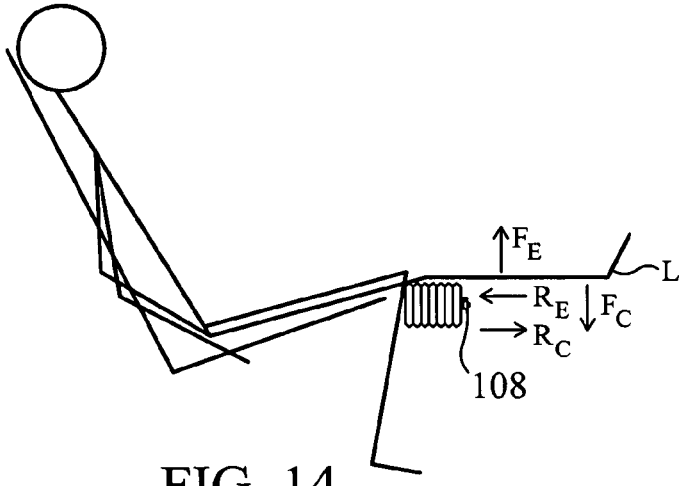
FIG. 14 is a schematic representation of exercising opposing muscles on a limb.

The first and second resistances can be used to exercise opposing muscle. Referring to FIG. 14, a schematic of a leg extension/hamstring exercise machine is shown. When a leg L is moved into an extended position, the quadriceps leg muscles are contracted. Similarly, when the leg L is moved into a flexed position, the hamstring muscles are contracted. The accordion bladder 108 of the present invention can be positioned in a leg machine, such that the bladder 108 provides a resistance to both flexion and extension of the leg. For example, the bladder 108 is positioned in the leg machine such that when the leg is flexed, a compressive force $F_C$ is applied to the bladder (see also FIG. 12). The bladder 108 provides a first resistance, resisting the compressive force $F_C$. When the leg is extended, an expansive force $F_E$ is applied to the bladder 108 (see also FIG. 13). The bladder 108 provides a second resistance, resisting the expansive force $F_E$. The first and second resistances exercise the hamstring and quadriceps muscles. It is contemplated that the bladder can be used as a stand alone device or incorporated into an exercise machine systematically exercising opposing muscles groups, such as, chest/upper back, abdominal/lower back, quadriceps/hamstring, biceps/triceps, etc.

Figure 15A:
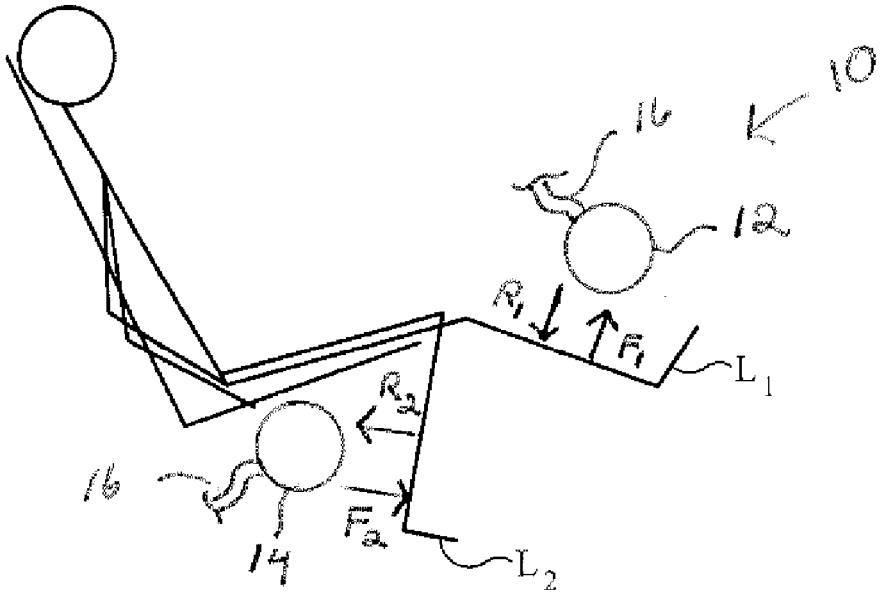
FIGS. 15A–B are schematic representations of a first embodiment for exercising agonist and antagonist muscles of opposite limbs.

Referring to FIG. 15A, the bladder system 10 of the present invention can be positioned in a leg machine, such that the bladders 12 and 14 provide forces to agonist and antagonist muscles of opposite legs. An agonist muscle is a muscle that contracts when another muscle relaxes and an antagonist muscle is a muscle that relaxes when another muscle contracts. For example, when performing a leg extension exercise, the quadriceps muscle (the agonist muscle) contracts and the hamstring (the antagonist muscle) relaxes when the leg is extended.

In an exemplary embodiment, the bladder 12 is positioned in the leg machine such that when a first leg $L_1$ is extended from an initial position, a first force $F_1$ is applied to the bladder 12. The bladder 12 provides a first resistance $R_1$ to the quadricep muscle (agonist muscle) resisting the extension of the first leg $L_1$. Simultaneously and in response to the first force $F_1$, the fluid from bladder 12 is forced through the tube 16 into bladder 14, expanding bladder 14. The expansion of bladder 14 provides a second force $F_2$ to the second leg $L_2$, tending to force the second leg $L_2$ into the extending position. The hamstring muscle (antagonist muscle) of the second leg $L_2$ provides a second resistance $R_2$ resisting the second force $F_2$, moving the second leg $L_2$ into flexion. In this manner the quadriceps muscle of the first leg $L_1$ and the hamstring muscle of the second leg $L_2$ are simultaneously exercised.

In the above described motion, the first and second bladders 12 and 14 provide positive exertions to the quadricep muscle of the first leg $L_1$ and the hamstring muscle of the second leg $L_2$. Upon completion of the motion, the first force $F_1$ is released, wherein, similar to free weights, the bladder system 10 tends to conform back to the equilibrium position, initial position. As such, the bladders 12 and 14 provide forces to the first and second legs as the fluid in the bladders 12 and 14 moves to the equilibrium position. The resistance of these forces provides a negative exertion on the quadricep muscle of the first leg $L_1$ and the hamstring muscle of the second leg $L_2$ as the first and second legs $L_1$ and $L_2$ move to the initial position.

Figure 15B:
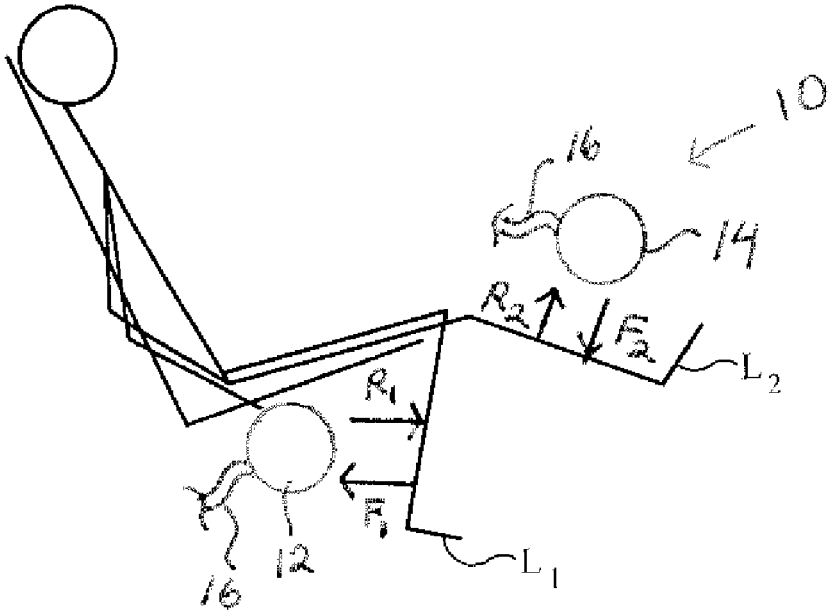

Referring to FIG. 15B, the bladder system 10 of the present invention can be positioned in a leg machine such that as first leg $L_1$ is flexed, a first force $F_1$ is applied to the bladder 12. The bladder 12 provides a first resistance $R_1$ to the hamstring muscle, agonist muscle, resisting the flexion of the first leg L. Simultaneously and in response to the first force $F_1$, the fluid from bladder 12 is forced through the tube 16 into bladder 14, expanding bladder 14. The expansion of bladder 14 provides a second force $F_2$ to the second leg $L_2$, tending to force the second leg $L_2$ into the flexed position. The quadricep muscle, antagonist muscle, of the second leg $L_2$ provides a second resistance $R_2$ resisting the second force $F_2$, moving the second leg $L_2$ into an extended position. In this manner the hamstring muscle of the first leg $L_1$ and the quadricep muscle of the second leg $L_2$ are simultaneously exercised. As with the previous embodiment, the bladders 12 and 14 can likewise provide negative exertions on the hamstring muscle of the first leg $L_1$ and the quadricep muscle of the second leg $L_2$ as the first and second legs $L_1$ and $L_2$ move to the initial position.

Figure 16A:
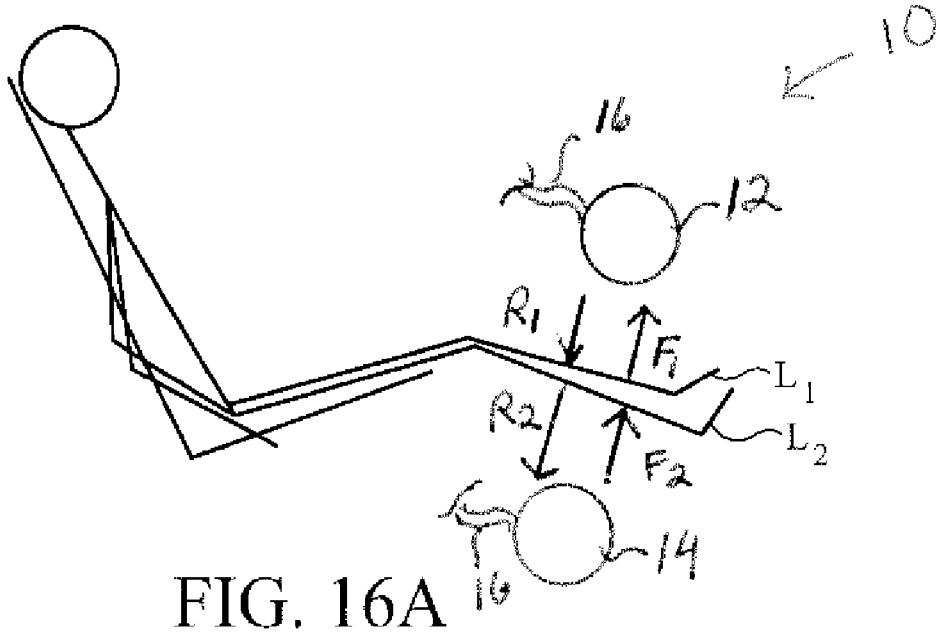
FIGS. 16A–B are schematic representations of a second embodiment for exercising agonist and antagonist muscles of opposite limbs.

Referring to FIG. 16A, the bladder system 10 of the present invention can be positioned in a leg machine, such that the bladders 12 and 14 provide forces to agonist and antagonist muscles of opposite legs, wherein the legs move in the same direction. The bladder 12 is positioned in the leg machine such that when a first leg $L_1$ is extended from an initial position a first force $F_1$ is applied to the bladder 12. The bladder 12 provides a first resistance $R_1$ to the quadricep muscle resisting the extension of the first leg $L_1$. Simultaneously and in response to the first force $F_1$, the fluid from bladder 12 is forced through the tube 16 into bladder 14, expanding bladder 14. The expansion of bladder 14 provides a second force $F_2$ to the second leg $L_2$, forcing the second leg $L_2$ into the extending position. The hamstring muscle of the second leg $L_2$ provides a second resistance $R_2$ resisting the second force $F_2$. In this manner the quadriceps muscle of the first leg $L_1$ is provided with a positive exertion and the hamstring muscle of the second leg $L_2$ is provided with a negative exertion.

Figure 16B:
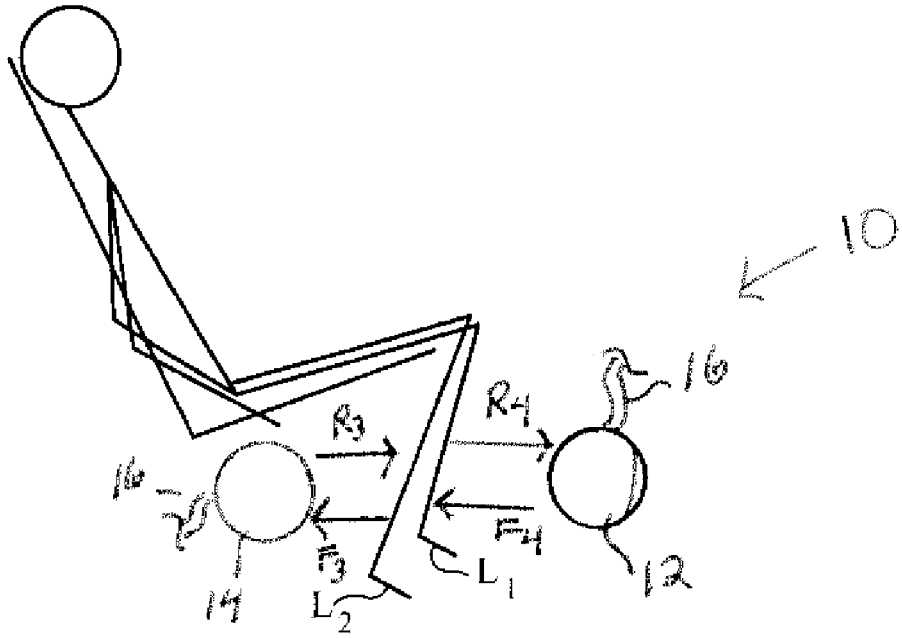

Upon completion of the motion, both the first and second legs $L_1$ and $L_2$ are in the extended position. Referring to FIG. 16B, the second leg $L_2$ is then flexed, applying a third force $F_3$ to the bladder 14. The bladder 14 provides a third resistance $R_3$ to the hamstring muscle resisting the flexion of the second leg $L_2$. Simultaneously and in response to the third force $F_3$, the fluid from bladder 14 is forced through the tube 16 into bladder 12, expanding bladder 12. The expansion of bladder 12 provides a fourth force $F_4$ to the first leg $L_1$, forcing the first leg $L_1$ into the flexed position. The quadricep muscle of the first leg $L_1$ provides a fourth resistance $R_4$ resisting the fourth force $F_4$. The first and second legs $L_1$ and $L_2$ are moved into the flexed position, initial position. In this manner, the hamstring muscle of the second leg $L_2$ is provided with a positive exertion and the quadricep muscle of the first leg $L_1$ is provided with a negative exertion.

It is contemplated that the bladder 10, 102, or 108 can be used as a stand alone device or incorporated into an exercise machine systematically exercising agonist and antagonist muscle groups of opposing limbs, such as, quadriceps/hamstring, biceps/triceps, etc. It is further contemplated that regardless of the specific application, the device can include a tracking mechanism, such as a radio frequency identification (RFID) tag. One use for such a tracking mechanism would to be monitor patient compliance. In this regard, U.S. Patent Publication No. 2004/0215111, the contents of which are incorporated by reference herein, discloses a monitoring system and method that can be used with the present invention.

Figure 17A:
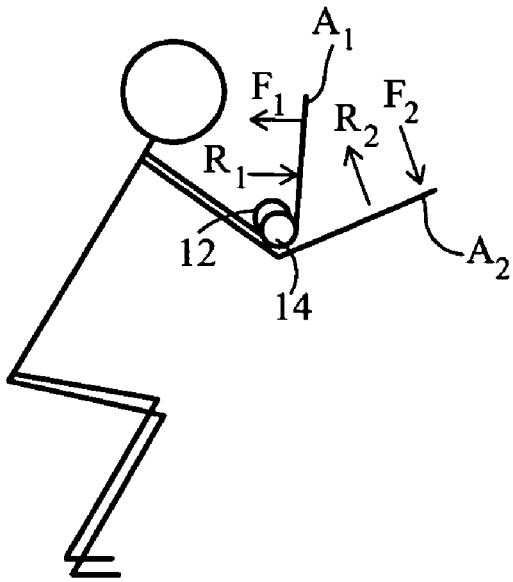
FIGS. 17A–B are schematic representations of exercising the same muscles on opposite limbs.

The bladder system of the present invention can be positioned on an exercise machine to provide a positive exertion to a first muscle and a negative exertion to a second muscle, wherein the first and second muscles include identical muscle on opposite limbs. Referring to FIG. 17A, the bladder system 10 of the present invention is positioned on a preacher curl machine. The bladder 12 is positioned in the curl machine such that when a first arm $A_1$ is flexed from an initial position a first force $F_1$ is applied to the bladder 12. The bladder 12 provides a first resistance $R_1$ to the bicep muscle, resisting the flexion of the first arm $A_1$. Simultaneously and in response to the first force $F_1$, the fluid from bladder 12 is forced through the tube 16 into bladder 14, expanding bladder 14. The expansion of bladder 14 provides a second force $F_2$ to the second arm $A_2$, forcing the second arm $A_2$ into the extending position. The bicep muscle of the second arm $A_2$ provides a second resistance $R_2$ resisting the second force $F_2$. In this manner the bicep muscle of the first arm $A_1$ is provided with an positive exertion and the bicep muscle of the second arm $A_2$ is provided with a negative exertion.

Figure 17B:
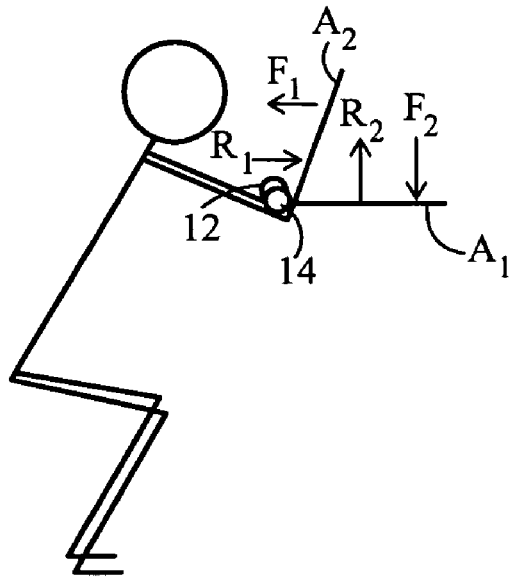

Referring to FIG. 17B, upon completion of the motion, the first arm $A_1$ is in the flexed position and the second arm $A_2$ is in the extended position. The second arm $A_2$ is then flexed, applying the first force $F_1$ to the bladder 14. The bladder 14 provides the first resistance $R_1$ to the bicep muscle, resisting the flexion of the second arm $L_1$. Simultaneously and in response to the first force F1, the fluid from bladder 14 is forced through the tube 16 into bladder 12, expanding bladder 12. The expansion of bladder 12 provides the second force $F_1$ to the first arm $A_1$, forcing the first arm $A_1$ into the extended position. The bicep muscle of the first arm $A_1$ provides the second resistance $R_2$ resisting the second force $F_2$. The second arm $A_2$ is moved into the flexed position and the first arm $A_1$ is moved into the extended position. In this manner the bicep muscle of the second arm $A_2$ is provided with a positive exertion and the bicep muscle of the first arm $A_1$ is provided with a negative exertion.

It is contemplated that the bladder 10, 102, or 108 can be used as a stand alone device or incorporated into an exercise machine systematically exercising identical muscle groups of opposing limbs, such as, providing a positive exercise to the muscle of the first limb and a negative exercise to the same muscle of the second limb. It is further contemplated that regardless of the specific application, the device can include a tracking mechanism, such as a radio frequency identification (RFID) tag. One use for such a tracking mechanism would to be monitor patient compliance. In this regard, the previously incorporated by reference U.S. Patent Publication No. 2004/0215111 can be used with the present invention.

Figure 18:
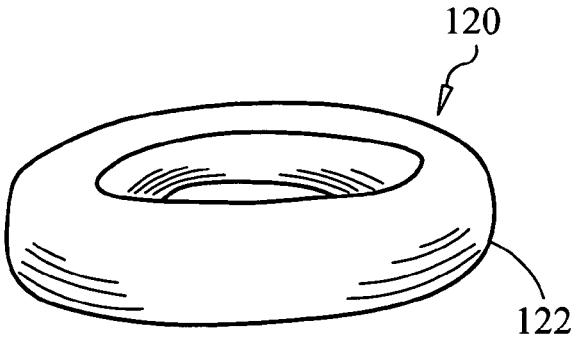
FIG. 18 depicts a cuff bladder exercise system of the present invention.
Figure 19:
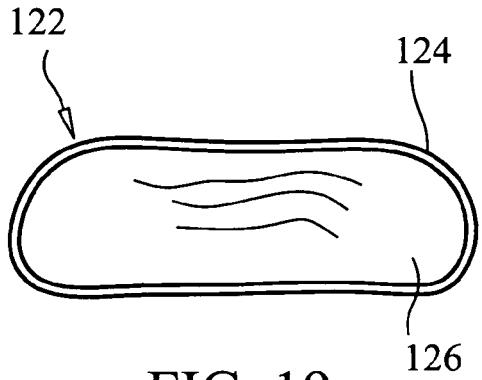
FIG. 19 depicts a sectional view of the cuff bladder exercise system of FIG. 18.

Referring to FIGS. 18 and 19, there is shown a cuff exercise system 120 of the present invention. The cuff 120 includes an annular ring 122 defining an annular bladder 124. The annular bladder 124 includes a compressible or non-compressible fluid 126 enclosed therein. The annular ring 122 is made of an elastic material have a stiffness $k_R$. The stiffness $k_R$ is selected to provide the desired resistance profile to the muscle or muscle group being exercised.

In use, the annular ring 122 is positioned about a muscle or muscle group. The contraction of the muscle pushes against the annular ring 122, causing a compression of the fluid 126 and corresponding expansion of the annular ring 122. The stiffness $k_R$ of the annular ring 122 resists the expansion of the annular ring 122, imparting a compressive force about the muscles. As a result, the muscles 128 must provide an expansive force to overcome the compressive force of the annular ring 122.

Figure 20:
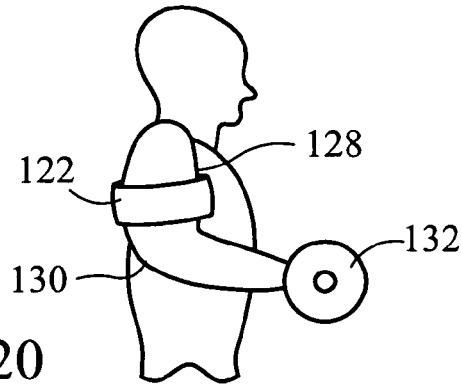
FIG. 20 depicts the cuff bladder exercise system of FIG. 19 in use during a bicep exercise.

Referring to FIG. 20, the annular ring 122 may be positioned about a bicep muscle 128. When the arm 130 is flexed, the bicep muscle 128 provides a pulling force to lift the weight 132, resulting in a contraction of the bicep muscle 128. The contracting bicep muscle 128 expands, pushing against the annular ring 122, causing a compression of the fluid 126 and corresponding expansion of the annular ring 122. The stiffness $k_R$ of the annular ring 122 resists the expansion of the annular ring 122, imparting a compressive force about the bicep muscle 128. As a result, the bicep muscle 128 must not only provide the pulling force to lift the weight 132, but also an expansive force to overcome the compressive force of the annular ring 122.

When lowering the weight, the bicep 128 provides a pulling force to controllable lower the weight 132. The compressive force applied by the annular ring 122 tends to increase the rate at which the weight 132 is lowered. In order to maintain a controlled lowering rate, the bicep 128 must provide an expansive force to overcome the compressive force of the annular ring 122.

The cuff 120 may include a mechanism for controlling the fluid pressure in the annular ring 122. The control mechanism may include a fill valve positioned annular ring 122. Fluid 126 is added or removed from the annular ring 122, increasing or decreasing the fluid pressure therein. The fluid can progressively added to removed from the annular ring 122 during the exercise to control the resistance profile.

Figure 21:
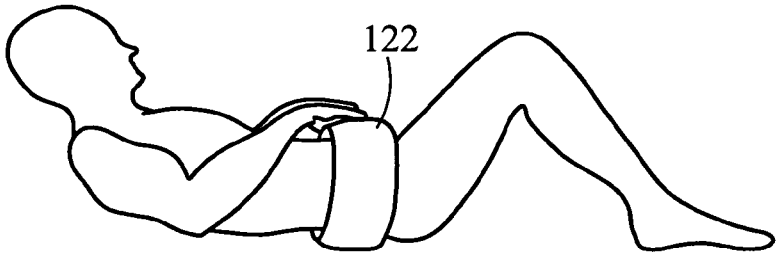
FIG. 21 depicts the cuff bladder exercise system of FIG. 19 in use during an abdominal exercise.

Referring to FIG. 21, the cuff 120 can be positioned about any muscle group, such as, abdominal/lower back, chest/upper back, quadriceps/hamstring, biceps/triceps, etc.

Figure 22:
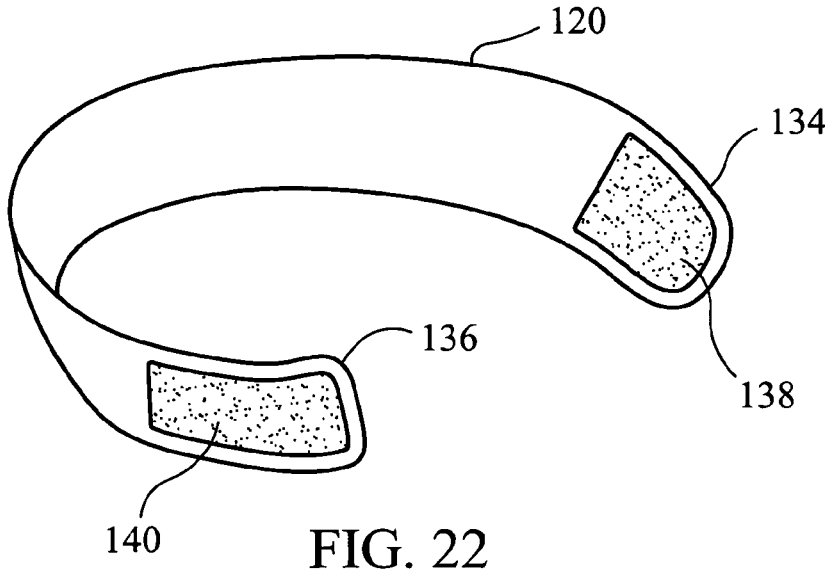
FIG. 22 depicts an adjustable cuff bladder exercise system of the present invention.

Referring to FIG. 22, the cuff 120 may be configured with attachments that allow the cuff to be adjustably fitted about the muscle group. For example, the cuff 120 may have first and second end portions 134 and 136 each including fastener members 138 and 140, to securely fit the cuff 120 about the muscle. The fastener members 138 and 140 are adjustable members, allowing the cuff 120 to be securely, snugly, fitted about the muscle. For example, the fastener members 138 and 140 are hook-and-loop type fasteners, or could involve a plurality of snaps, zippers or other fasteners.

Figure 23:
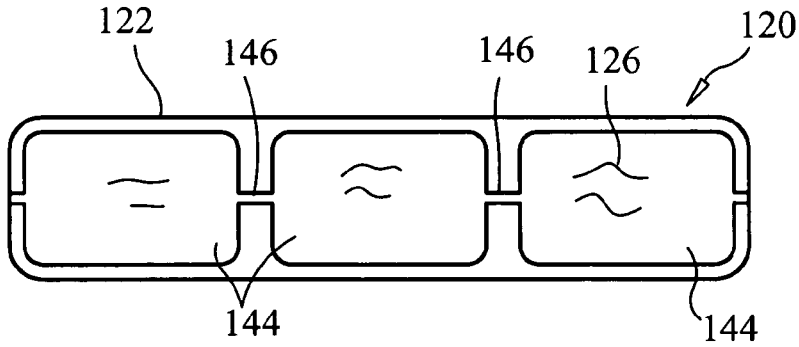
FIG. 23 depicts the cuff bladder exercise system of FIG. 19 including multiple serial bladders.

Referring to FIG. 23, the cuff 120 includes a plurality of bladder members 144 positioned serially within the annular ring 122. Each of the bladder member 144 includes a compressible or non-compressible fluid 126 enclosed therein and are made of elastic materials have a stiffness $k_R$. The stiffness $k_R$ of each of the bladder members 144 is selected to provide the desired resistance profile to the muscle or muscle group being exercised. Each of the bladder members 144 can have the same stiffness $k_R$ or a different stiffness $k_R$, depending on the desired resistance profile. Each of the adjacent bladder members 144 can be fluidly connected with tube member 146. As described above, the tube members 146 may also be used to control the resistance profile.

Figure 24:
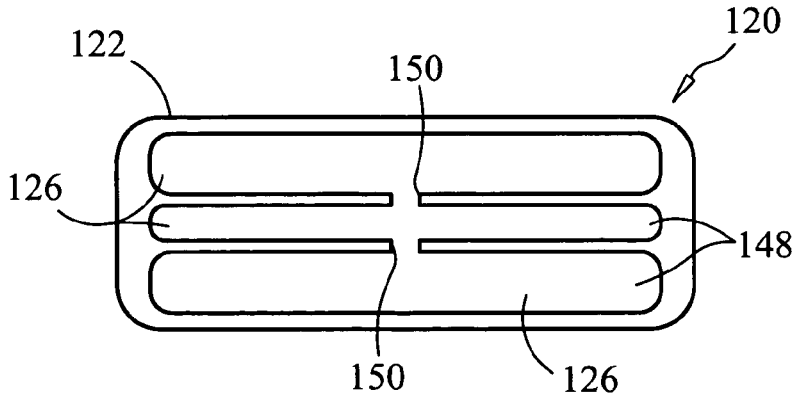
FIG. 24 depicts the cuff bladder exercise system of FIG. 19 including multiple stacked bladders.

Referring to FIG. 24, the cuff 120 includes a plurality of bladder members 148 positioned in a stacking arrangement within the annular ring 122. Each of the bladder members 148 includes a compressible or non-compressible fluid 126 enclosed therein and are made of elastic materials have a stiffness $k_R$. The stiffnesses $k_R$ of each of the bladder members 148 are selected to provide the desired resistance profile to the muscle or muscle group being exercised. Each of the bladder members 148 can have the same stiffness $k_R$ or a different stiffness $k_R$, depending on the desired resistance profile. Each of the adjacent bladder members 148 can be fluidly connected with tube member 150. As described above, the tube member 150 may also be used to control the resistance profile.

In another embodiment, the bladder system of the present invention includes so-called "smart materials". For example, the walls of the bladders may be constructed to include reinforcing fibers made of a shape memory alloy. A shape memory alloy possesses the properties of returning to an original shape after having been subjected to some form of deformation. The shape memory alloy returns to the original shape with the application of an energy to heat the alloy to a temperature above a transformation temperature. In an exemplary use, the shape memory alloy is provided in the cuff exercise system 120 of FIGS. 18 and 19.

As previously disclosed, the cuff exercise system 120 includes an annular ring 122 defining an annular bladder 124. The annular ring 122 is positioned about a muscle or muscle group. The contraction of the muscle pushes against the annular ring 122, causing a compression of the fluid 126 and corresponding expansion of the annular ring 122. The stiffness $k_R$ of the annular ring 122 resists the expansion of the annular ring 122, imparting a compressive force about the muscles. As a result, the muscles 128 must provide an expansive force to overcome the compressive force of the annular ring 122.

The inclusion of the shape memory alloy in the annular bladder 124 allows for a controlled application of the compressive force about the muscle. An application of an energy to the shape memory alloy, increasing the temperature of the shape memory alloy to the transition temperature, results in the shape memory alloy reverting to the original shape. The original shape of the shape memory alloy is designed to increase the stiffness $k_R$ of the annular bladder 124, further increasing the resistance to the expansion of the annular ring 122 and imparting an increased compressive force about the muscles.

It is contemplated that the annular bladder 124 can include a number of different shape memory alloys, each having a different transition temperature. The differing transition temperatures permit the shape memory alloys to be sequentially activated to increase the compressive force about the muscle.

The bladder system of the present invention can include an electro-rheological (ER) fluid. An ER fluid is a fluid which changes its physical properties in the presence of an electric field. For example, the application of an electric field increases the viscosity of the ER fluid, which if desired, can ultimate change from a liquid to a solid.

Referring again to FIG. 1, the bladder system 10 of the present invention uses a plurality of fluidly connected bladders to provide resistive forces to the muscles being exercised. The bladder system 10 includes first and second bladders 12 and 14 in fluid communication with each other, such as through a tube 16.

An ER fluid 18 is disposed within the bladders 12 and 14, such that a compression of one of the bladders 12 or 14 forces the ER fluid 18 through the tube 16 into the opposite bladder 12 or 14. The viscosity of the ER fluid 18 is used to control the resistance of the exercise device. The viscosity of the ER fluid 18 is selected to provide a specific maximum flow rate through the tube 16 without the presence of the electric field. The application of the electric field increases the viscosity of the ER fluid 18, decreasing the flow rate and providing a greater resistance. As the intensity of the electric field is increased, the viscosity of the ER fluid is similarly increased, increasing the resistance.

The smart materials of the above embodiments may be used individually or in combination to provide a bladder system having an increased range of useful resistance. Additionally, while having been described on specific embodiment of the present invention, this is for exemplary purposes only and it is contemplated that the smart materials can be similarly incorporated into other embodiments of the present invention.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An exercise device comprising:

a first bladder formed of a first material having a first elasticity such that the first bladder has a first stiffness corresponding to a first resistance to compression, a second bladder in fluid communication with the first bladder and formed of a second material having a second elasticity such that the second bladder has a second stiffness corresponding to a second resistance to compression whereby the second stiffness and corresponding second resistance to compression is greater than the first stiffness and corresponding first resistance to compression; and a fluid contained within the first and second bladders, wherein compression of the first bladder causes a portion of the fluid contained therein to be transferred to the second bladder, wherein the elasticity of the first material is at least about 1.5 times greater than the elasticity of the second material when no fluid is present in either bladder.

2. The exercise device of claim 1, further comprising a tube member fluidly connecting the first bladder to the second bladder.

3. The exercise device of claim 2, further comprising a control valve associated with the tube member to selectively control an inner diameter of the tube member.

4. The exercise device of claim 2, wherein at least one bladder may be selectively removed from the tube member.

5. The exercise device of claim 4, further comprising a third bladder that may be selectively interchanged with the first bladder to be in fluid communication with the second bladder.

6. The exercise device of claim 2, wherein both the first and second bladders may be selectively removed from the tube member.

7. The exercise device of claim 1 further comprising a fill valve disposed on the exercise device that permits fluid to be introduced or removed from the device.

8. The exercise device of claim 2, wherein the flow of fluid through the tube member provides a resistance in response to a compressive force applied either to the first or second bladder.

9. The exercise device of claim 1, wherein the first bladder is larger in volume than the second bladder, the first bladder having a fluid pressure substantially equal to the fluid pressure in the second bladder.

10. The exercise device of claim 2, wherein a portion of the surfaces of the first and second bladders are pleated.

11. The exercise device of claim 10, wherein an expansive force is applied to the first bladder drawing the fluid through the tube member into the first bladder expanding the first bladder.

12. The exercise device of claim 11, wherein a diameter of the tube member limits the flow of the fluid through the tube member providing a resistance to the expansive force.

13. The exercise device of claim 1, wherein application of a first force on the first bladder involves exertion of a first muscle group and results in an application of a second force by the second bladder on a second muscle group, antagnostic to the first muscle group.

14. The exercise device of claim 1, wherein application of a first force on the first bladder involves a positive exertion of a first muscle group and results in an application of a second force by the second bladder on a second muscle group, resulting in a negative exertion of the second muscle group.

15. The exercise device of claim 14, where the first and second muscles are the same muscle groups on opposite limbs of an individual.

16. The exercise device of claim 1, wherein application of a first force on the first bladder involves a positive exertion of a first muscle group and results in an application of a second force by the second bladder on a second muscle group, resulting in a positive exertion of the second muscle group.

17. An exercise device comprising:

a first bladder formed of a first material having a first stiffness and a first elasticity corresponding to a first resistance to compression, a second bladder in fluid communication with the first bladder and formed of a second material having a second stiffness and a second elasticity corresponding to a second resistance to compression whereby the second stiffness and resistance to compression is greater than the first stiffness and resistance to compression; and a fluid contained within the first and second bladders, wherein compression of the first bladder causes a portion of the fluid contained therein to be transferred to the second bladder and wherein the first bladder is larger in volume than the second bladder under substantially equal fluid pressures and wherein the elasticity of the first bladder is at least about 1.5 times greater than the elasticity of the second bladder when both are at a static state with no fluid present in each bladder.

* * * * *